US006637421B2

(12) United States Patent
Smith et al.

(10) Patent No.: US 6,637,421 B2
(45) **Date of Patent: *Oct. 28, 2003**

(54) PNEUMATICALLY OPERATED PROJECTILE LAUNCHING DEVICE

(75) Inventors: David L. Smith, East Aurora, NY (US); Raymond S. Gaston, Lancaster, NY (US); William M. Gardner, Jr., Ligonier, PA (US); Adam Gardner, Ligonier, PA (US)

(73) Assignee: Smart Parts, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 10/254,891

(22) Filed: Sep. 24, 2002

(65) Prior Publication Data

US 2003/0024521 A1 Feb. 6, 2003

Related U.S. Application Data

(63) Continuation of application No. 09/490,735, filed on Jan. 25, 2000, now Pat. No. 6,474,326, which is a continuation of application No. 08/586,960, filed on Jan. 16, 1996, now Pat. No. 6,035,843.

(51) Int. Cl.[7] ..... F41B 11/00
(52) U.S. Cl. ..... 124/77; 124/32
(58) Field of Search ..... 124/77, 32, 73, 124/54, 72, 74; 42/84

(56) References Cited

U.S. PATENT DOCUMENTS

| | | | | |
|---|---|---|---|---|
| 2,554,116 A | | 5/1951 | Monner | |
| 2,594,240 A | | 4/1952 | Wells | |
| 2,634,717 A | | 4/1953 | Junkin | |
| 2,845,055 A | | 7/1958 | Collins et al. | |
| 4,009,536 A | * | 3/1977 | Wolff | 42/84 |
| 4,094,294 A | | 6/1978 | Speer | 124/56 |
| 4,269,163 A | | 5/1981 | Feith | 124/77 |
| 4,362,145 A | * | 12/1982 | Stelcher | 124/32 |
| 4,730,407 A | * | 3/1988 | DeCarlo | 42/84 |
| 4,770,153 A | * | 9/1988 | Edelman | 124/72 |
| 4,936,282 A | | 6/1990 | Dobbins et al. | 124/74 |
| 5,063,905 A | | 11/1991 | Farrell | 124/72 |
| 5,261,384 A | * | 11/1993 | Hu | 124/66 |
| 5,881,707 A | * | 3/1999 | Gardner, Jr. | 124/77 |
| 5,967,133 A | * | 10/1999 | Gardner, Jr. | 124/77 |
| 6,035,843 A | * | 3/2000 | Smith et al. | 124/77 |
| 6,343,599 B1 | * | 2/2002 | Perrone | 124/73 |
| 6,349,711 B1 | * | 2/2002 | Perry et al. | 124/73 |
| 6,474,326 B1 | * | 11/2002 | Smith et al. | 124/77 |

FOREIGN PATENT DOCUMENTS

| | | |
|---|---|---|
| EP | 94026535 | 2/1993 |
| GB | 2146416 A | 4/1985 |
| JP | 1179898 | 7/1989 |
| JP | 7004892 | 1/1995 |

* cited by examiner

*Primary Examiner*—Charles T. Jordan
*Assistant Examiner*—John W Zerr
(74) *Attorney, Agent, or Firm*—Marger Johnson & McCollom, P.C.

(57) ABSTRACT

An electronically-operated pneumatic launching device preferably includes a gun-shaped body having a trigger. A bolt preferably permits a projectile to be loaded into a chamber during a loading operation. The bolt can be configured to be opened by the application of pneumatic force. A valve is preferably located in the body and selectively supplies compressed gas from a compressed gas source to the chamber during a firing operation. An electrical circuit is also preferably arranged in the body to initiate the firing operation of the paintball gun in response to actuation of the trigger.

20 Claims, 4 Drawing Sheets

PNEUMATICALLY OPERATED PROJECTILE LAUNCHING DEVICE

This application is a continuation of U.S. patent application Ser. No. 09/490,735 (now U.S. Pat. No. 6,474,326), filed Jan. 25, 2000, which is a continuation of patent application Ser. No. 08/586,960 (now U.S. Pat. No. 6,035,843), filed Jan. 16. 1996.

BACKGROUND OF THE INVENTION

The current invention consists of a device for launching a projectile using pneumatic force. Guns using pneumatic force to propel a projectile are well known. In particular, it is well known to use pneumatic force to fire a fragile spherical projectile containing a colored, viscous substance (known as a "paintball") which bursts upon impact with a target. However pneumatically operated guns used in paintball applications (as well as existing pneumatically operated guns in general) suffer from several deficiencies affecting the accuracy of the shot which are eliminated by the present invention.

Existing pneumatically operated guns invariably use a spring mechanism in some fashion to aid in generating the propellent force necessary to fire the projectile at the desired velocity from the gun. The use of a spring creates a non-linear transformation of energy from a pneumatically stored potential form into kinetic acceleration of the projectile, since the spring releases continuously less energy as it expands from its maximum deformation to its undeformed natural state. In the case of any flexible projectile in general and particularly in the case of paintballs, this non-linear transformation of energy causes some deformation in the shape of the projectile that alters the ballistic forces created upon it in flight, adversely affecting the accuracy with which the projectile can be fired to strike its intended target. The adverse ballistic effects stemming from projectile deformation are particularly felt at the low projectile-velocities required in paintball applications for player safety. Given the spring forces used in the existing state of the art, it is necessary to fire a paintball at the highest pneumatic pressures possible in order to eliminate these adverse ballistic effects. This has caused development of a thicker paintball shell to eliminate paintball breakage within the firing chamber of the gun. This increased thickness has in turn created a problem with paintball breakage as it impacts its target. To eliminate all of these problems without sacrificing player safety, it has become necessary in paintball applications to find a way to minimize projectile deformation at low pneumatic pressure levels, in order to permit the accurate sighting and firing of a low velocity shot.

The present invention solves all of these problems by eliminating the use of spring mechanisms in the transfer of energy to the projectile during the launching sequence. The invention uses a launching sequence which results in only the application of pneumatic force to the projectile. This creates a linear change in the amount of energy that is applied to the projectile as the pneumatically stored energy undergoes expansion and decompression upon release. This in turn minimizes the physical deformation of the projectile during the launching sequence, increasing the accuracy of the shot. In paintball applications, this linear application of force contributes greatly to increased accuracy, since a non-linear transfer of force at the low pressures required to limit paintball velocities to safe levels exaggerates the adverse ballistic effects on the paintball, due to its low velocity.

The accuracy of the present invention has been proven through testing at the projectile velocity levels used in paintball applications. Ten shot clusters from a conventional hand held paintball gun that is fired from a target distance of 60 yards typically exhibits an average maximum inaccuracy of 15 inches for projectile velocities in the 290 to 300 feet per second range. The same conventional paintball gun shot under the same conditions from a rigid mount typically exhibits an average maximum inaccuracy of 10 inches. In contrast, the present invention exhibited an average maximum inaccuracy of less than 8 inches when fired from a hand held position, and an average maximum inaccuracy of 4 inches when rigidly mounted.

The invention also provides increased aiming accuracy through the use of a cam shaped trigger and electrical switch arrangement to initiate the projectile launching sequence. This arrangement minimizes the pull force necessary to engage the switch by contact with the trigger, due to the mechanical advantage provided by the transfer of force through the cam. This in turn minimizes the amount of hand and arm movement experienced upon pulling the trigger, which increases firing accuracy.

Finally, the present invention also provides a significant accuracy advantage over all prior art spring-loaded guns at all pneumatic operating pressures, due to the minimized recoil experienced after a shot is fired. Typical spring-loaded guns exhibit greater recoil than does the invention, due to the non-linear reaction forces created on the gun body by the expansion of the spring. In contrast, the elimination of spring loading in the present invention eliminates these non-linear forces, minimizing the amount of recoil experienced and thus allowing greater accuracy over all types of existing spring-loaded gun designs in the firing of a shot.

Accordingly, it is an object of the present invention to provide a projectile launching device that uses only pneumatic force to propel a projectile.

It is also an object of the present invention to provide a projectile launching device for use in the recreational and professional sport of paintball that uses only pneumatic force to propel the paintball.

It is also an object of the present invention to provide a projectile launching device which can be aimed and fired with greater accuracy than all types of spring-loaded guns at all pneumatic operating pressures.

It is also an object of the present invention to provide a projectile launching device for use in the recreational and professional sport of paintball which can be aimed and fired with greater accuracy than existing paintball guns at low pneumatic operating pressures.

It is also an object of the present invention to provide a projectile launching device that uses electro-pneumatic control to release the pneumatic force that propels the projectile.

It is also an object of the present invention to provide a projectile launching device for use in the recreational and professional sport of paintball that uses electro-pneumatic control to release the pneumatic force that propels the projectile.

SUMMARY OF THE INVENTION

The pneumatically operated projectile launching device is preferably comprised of three principal elements: a body which houses and interconnects all of the pneumatic components and also houses the electrical power source, a grip mounted to the body which includes an electrical switch that activates a launching sequence, and an electrical control unit housed within both the body and the grip which directs flow between the pneumatic components to load, cock and fire the gun.

The body preferably contains a plurality of bores in communication with each other including a bore containing and distributing pressurized gas, a bore containing a compressed gas storage chamber and mechanisms for filling the storage chamber with gas and releasing gas from the storage chamber to fire the projectile, and a bore containing mechanisms for loading and launching the projectile. The electrical control unit preferably includes an electrical power source which activates an electrical timing circuit when the electrical switch is closed, and two electrically operated pneumatic flow distribution devices which are sequentially energized by the electrical timing circuit to enable the loading of a projectile for launching and to release compressed gas from the storage chamber to fire the projectile, respectively.

Before the initiation of a launching sequence the compressed gas storage chamber is filled with compressed gas while the projectile launching mechanism is disabled. Filling of the compressed gas storage chamber is preferably accomplished automatically by actuation of the compressed gas filling mechanism. When the electrical switch is closed to initiate the launching sequence the projectile is first loaded into the launching mechanism by electrical timing circuit actuation of the first electrically operated pneumatic flow distribution device. The projectile is then fired when the electrical timing circuit actuates the second electrically operated pneumatic flow distribution device to release gas from the compressed gas storage chamber into the launching mechanism.

The present invention eliminates the use of spring mechanisms in the transfer of energy to the projectile during the launching sequence. The invention uses a launching sequence which results in only the application of pneumatic force to the projectile. This creates a linear change in the amount of energy that is applied to the projectile as the pneumatically stored energy undergoes expansion and decompression upon release. This in turn minimizes the physical deformation of the projectile during the launching sequence, increasing the accuracy of the shot. In paintball applications, this linear application of force contributes greatly to increased accuracy, since a non-linear transfer of force at the low pressures required to limit paintball velocities to safe levels exaggerates the adverse ballistic effects on the paintball, due to its low velocity.

The accuracy of the present invention has been proven through testing at the projectile velocity levels used in paintball applications. Ten shot clusters from a conventional hand held paintball gun that is fired from a target distance of 60 yards typically exhibits an average maximum inaccuracy of 15 inches for projectile velocities in the 290 to 300 feet per second range. The same conventional paintball gun shot under the same conditions from a rigid mount typically exhibits an average maximum inaccuracy of 10 inches. In contrast, the present invention exhibited an average maximum inaccuracy of less than 8 inches when fired from a hand held position, and an average maximum inaccuracy of 4 inches when rigidly mounted.

The invention also provides increased aiming accuracy through the use of a cam shaped trigger and electrical switch arrangement to initiate the projectile launching sequence. This arrangement minimizes the pull force necessary to engage the switch by contact with the trigger, due to the mechanical advantage provided by the transfer of force through the cam. This in turn minimizes the amount of hand and arm movement experienced upon pulling the trigger, which increases firing accuracy.

Finally, the present invention also provides a significant accuracy advantage over all prior art spring-loaded guns at all pneumatic operating pressures, due to the minimized recoil experienced after a shot is fired. Typical spring-loaded guns exhibit greater recoil than does the invention, due to the non-linear reaction forces created on the gun body by the expansion of the spring. In contrast, the elimination of spring loading in the present invention eliminates these non-linear forces, minimizing the amount of recoil experienced and thus allowing greater accuracy over all types of existing spring-loaded gun designs in the firing of a shot.

BRIEF DESCRIPTION OF THE DRAWINGS

FIG. (1) is a side view of the pneumatically operated projectile launching device.

FIG. (1A) is a side view of the pneumatically operated projectile launching device.

Figure 1:
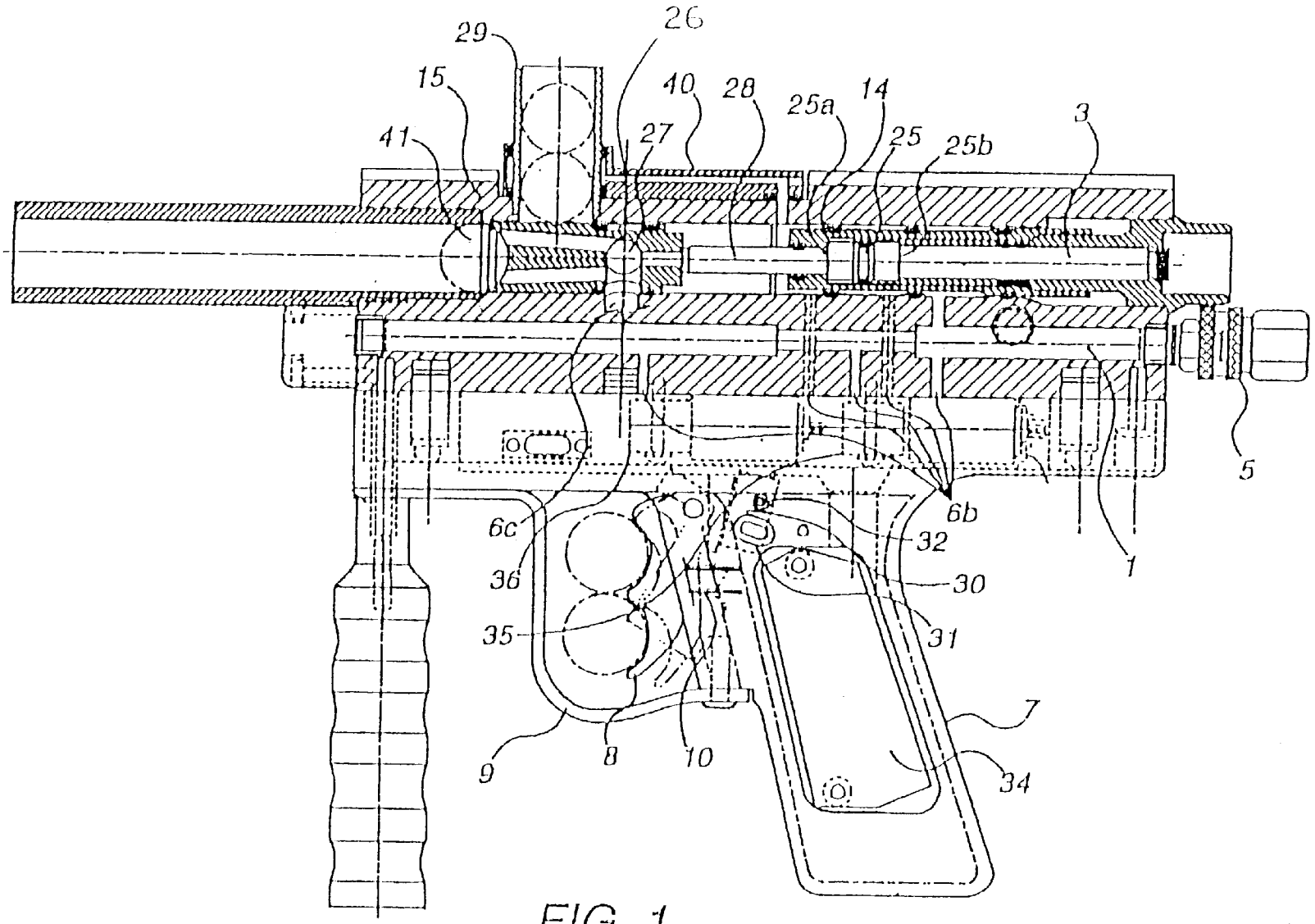
Figure 1A:
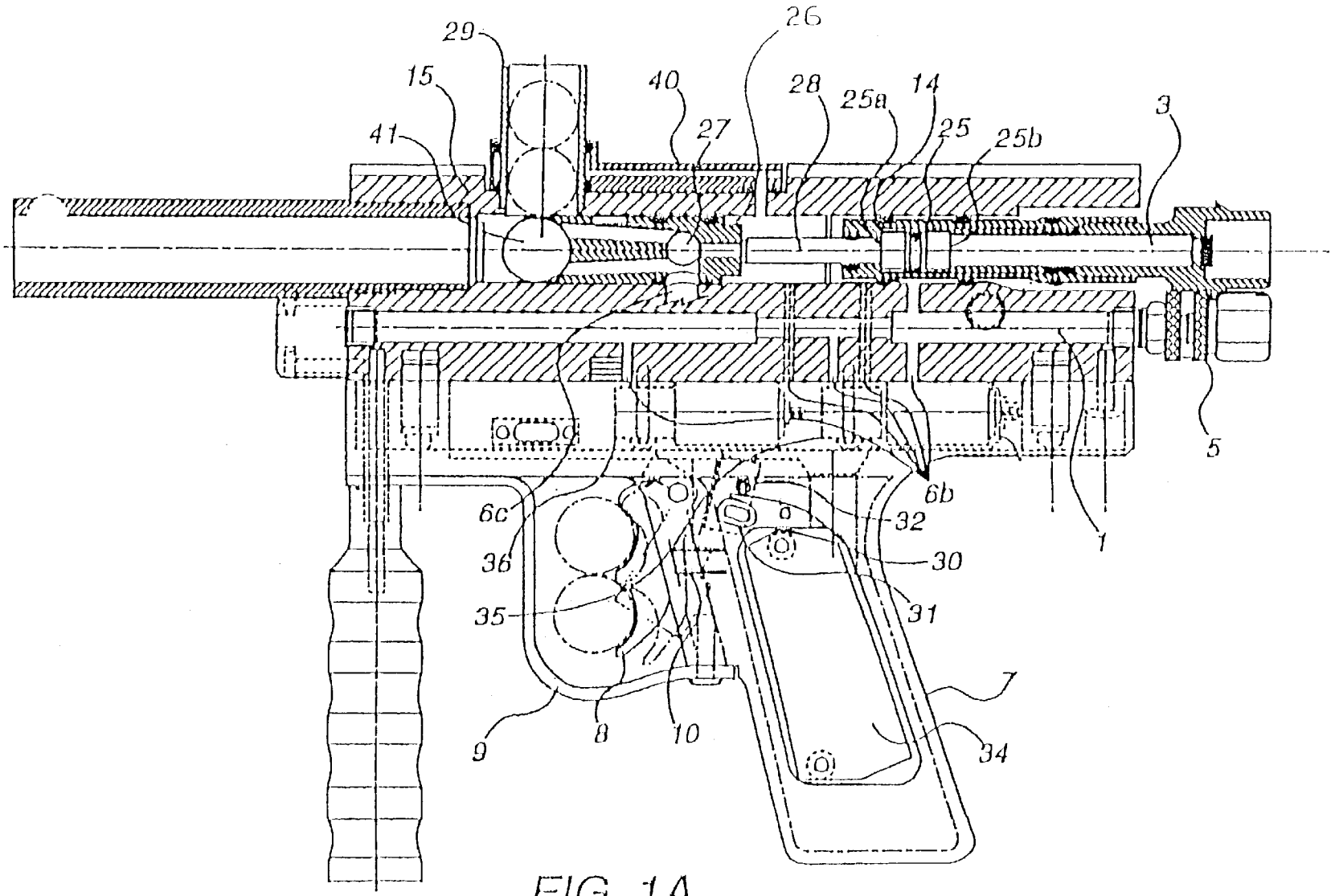
Figure 2:
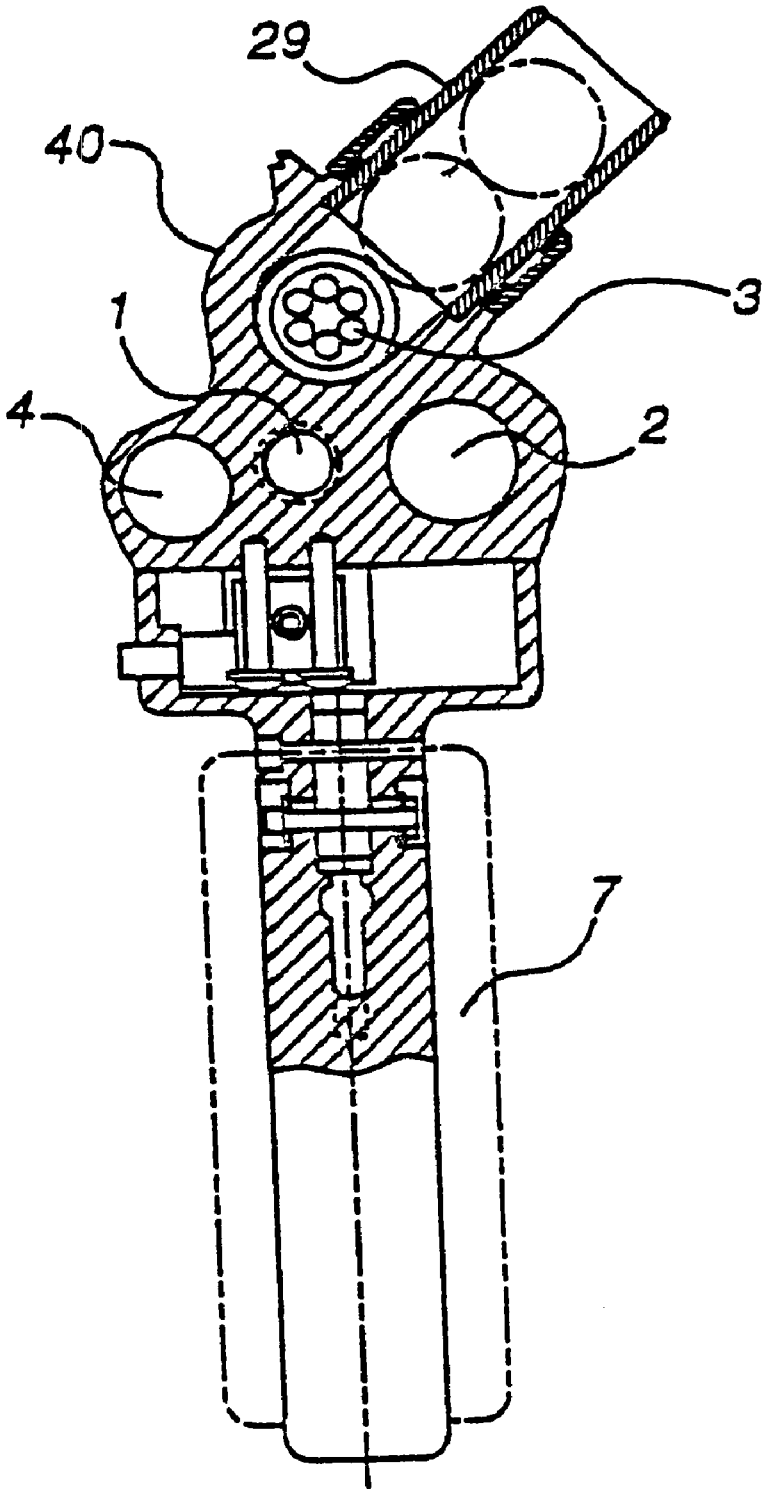
Figure 3:
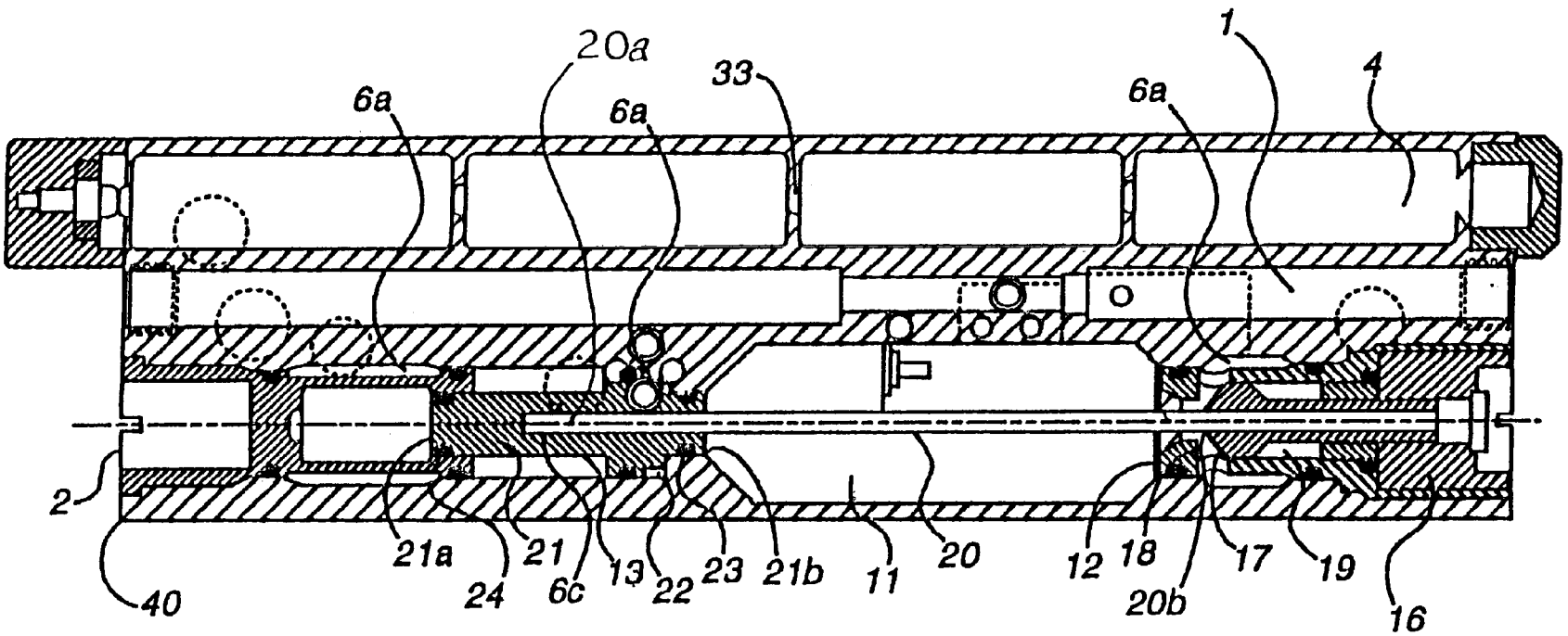

FIG. (2) is a rear view of the pneumatically operated projectile launching device.

FIG. (3) is a top view of the body of the pneumatically operated projectile launching device.

DETAILED DESCRIPTION OF THE PREFERRED EMBODIMENT

The pneumatically operated projectile launching device is preferably comprised of three principal elements: a body which houses and interconnects all of the pneumatic components and also houses the electrical power source; a grip mounted to the body which includes a trigger and an electrical switch that activates the launching sequence; and an electrical control unit housed within both the body and the grip which directs flow between the pneumatic components to load, cock and fire the gun.

As shown in FIG. (2), the body preferably has three cylindrical pneumatic bores with axes that are preferably parallel to the longitudinal axis of the gun body 40. The gun body 40 can be made of materials suitable in the art for withstanding the force of the launching sequence such as metal or plastic. The first bore 1 contains compressed gas and is preferably sealed by a removable fitting 5 which is removed to inject the gas. The first bore 1 is preferably in communication with the second bore 2 and the third bore 3 through a series of ported passageways 6*a* and 6*b*, respectively, bored through the interior of the gun body 40. As shown in FIG. (3), the second bore 2 houses the compressed gas storage chamber 11, the compressed gas filling mechanism 12 and the compressed gas releasing mechanism 13. The third bore 3 is also preferably in communication with both the first bore 1 and the second bore 2 through a series of ported passageways 6*b* and 6*c*, respectively, bored through the interior of the gun body 40. As shown in FIG. (1), the third bore 3 houses the projectile loading mechanism 14 and the projectile launching mechanism 15.

As shown in FIG. (3), the compressed gas storage chamber 11 is bordered by the interior walls of the second bore 2 and by the compressed gas filling mechanism 12 on one end and by the compressed gas releasing mechanism 13 on the end opposite the compressed gas filling mechanism 12. The compressed gas storage chamber 11 is filled with compressed gas from the first bore 1 by means of the interconnections 6*a* between the first bore 1 and the second bore 2 when the compressed gas filling mechanism 12 is actuated. The compressed gas storage chamber 11 releases stored gas to the projectile launching mechanism 15 by means of the interconnections 6*c* between the second bore 2 and the third bore 3 when the compressed gas releasing mechanism 13 is actuated.

As shown in FIG. (3), the compressed gas filling mechanism 12 preferably consists of a valve 16 with a metallic or plastic conically or spherically shaped plug 17 which is normally shut against a metallic, plastic, or rubber conically or concavely shaped seat 18 by the loading of a spring 19 when the compressed gas filling mechanism 12 is not in its actuated position. The plug 17 is attached to a second end 20*b* of a metallic or plastic rod-shaped mechanical linkage 20 which opens the valve 16 by compressing the spring 19 when the compressed gas filling mechanism 12 is in its actuated position to create a flow path for compressed gas from the first bore 1 to the compressed gas storage chamber 11.

As shown in FIG. (3), the mechanical linkage 20 passes through the compressed gas storage chamber 11 and has a first end 20*a* which is attached to the compressed gas releasing mechanism 13. The compressed gas releasing mechanism 13 preferably consists of a metallic or plastic cylindrical piston 21 which slides along the longitudinal axis of the second bore 2 in a space adjacent to the compressed gas storage chamber 11. A second end 21*b* of the piston 21 is adjacent to the compressed gas storage chamber 11 and is connected to the first end 20*a* of the mechanical linkage 20. The second end of the piston 21*b* has a flexible O-ring seal 23 made of rubber or other suitable synthetic sealing materials such as polyurethane that prevents gas leakage out of the compressed gas storage chamber 11. Compressed gas from the first bore 1 is applied to the second end of the piston 21*b* to actuate the compressed gas releasing mechanism 13 by unseating the O-ring 23 sealing the compressed gas storage chamber 11 to allow stored gas to be released from the compressed gas storage chamber 11 into the projectile launching mechanism 15 by means of the interconnections 6*c* between the second bore 2 and the third bore 3. The piston 21 contains a notched area 22 adjacent to the O-ring 23 that provides a surface for applying compressed gas pressure from the first bore 1 to unseat the O-ring 23 and actuate the compressed gas releasing mechanism 13.

The piston 21 has a first end 21*a* opposite the compressed gas storage chamber 11 which is subjected to pneumatic pressure to actuate the compressed gas filling mechanism 12 by transmitting through the mechanical linkage 20 a compression force on the spring 19 that opens the valve 16. The opening in the valve 16 is formed when the plug 17 is separated from the seat 18 to create a flow path for compressed gas from the first bore 1 to the compressed gas storage chamber 11 by means of the interconnections 6*a* between the first bore 1 and the second bore 2. Compressed gas from the first bore 1 is applied to the first end of the piston 21*a* to open the valve 16 and actuate the compressed gas filling mechanism 12. The first end of the piston 21*a* also contains a flexible O-ring seal 24 which prevents actuating pressure leakage into the compressed gas storage chamber 11 when the compressed gas filling mechanism 12 is actuated.

As shown in FIG. (1), the third bore 3 of the gun body 40 houses the projectile loading mechanism 14 and the projectile launching mechanism 15. The projectile loading mechanism 14 preferably consists of a metallic or plastic cylindrical piston 25 which slides along the longitudinal axis of the third bore 3. The projectile launching mechanism 15 preferably consists of a metallic or plastic cylindrical bolt 26 which also slides along the longitudinal axis of the third bore 3 and which has a port 27 for receiving released gas from the compressed gas storage chamber 11 to propel a projectile 41 from the gun body 40. The bolt 26 is connected to the piston 25 by a metallic or plastic rod-shaped mechanical linkage 28, which moves the bolt 26 to receive the projectile 41 by gravity loading from the projectile feed mechanism 29 when the projectile loading mechanism 14 is actuated.

The projectile loading mechanism 14 is actuated when compressed gas from the first bore 1 is applied by means of the interconnections 6*b* between the first bore 1 and the third bore 3 to a first end 25*a* of the piston 25 which is attached to the mechanical linkage 28. This compressed gas acts against the piston 25 and the mechanical linkage 28 to drive the bolt 26 back to the cocked position which enables the loading of a projectile 41 into engagement with the bolt 26 from the projectile feed mechanism 29. The subsequent release of stored gas from the compressed gas storage chamber 11 through the bolt port 27 will drive the projectile 41 from the gun body 40. After the launching sequence has been completed compressed gas is applied from the first bore 1 to a second end 25*b* of the piston 25 opposite the mechanical linkage 28 to disable the bolt 26 from receiving a projectile 41 by driving the bolt 26 to the shut position.

The second principal element is the grip, shown in FIG. (1). The grip is mounted to the body and preferably houses three principal components, a handle 7, a trigger 8 and an electrical switch 30. The handle 7 can be made of any suitable material such as metal or plastic and is preferably shaped with a hand grip to allow the gun to be held in a pistol-like fashion. The metallic or plastic trigger 8 is attached to the handle 7 and preferably has a leading edge shaped to be pulled by two fingers with a cam shaped trailing edge to engage the electrical switch 30. A trigger guard 9 which prevents accidental trigger displacement is preferably attached to the trigger 8. A spring 10 preferably returns the trigger 8 to a neutral position after the electrical switch 30 has been contacted to initiate a launching sequence. The electrical switch 30 is preferably a two-pole miniature switch which contains a plunger 31 loaded by a spring 32.

As shown in FIG. (1), the third principal element is the electrical control unit which is housed within both the body and the grip. The electrical control unit preferably consists of an electrical timing circuit 34 housed in the handle 7 along with two electrically operated 3-way solenoid valves 35 and 36 housed in the gun body 40 and an electrical battery power source 33 housed in a fourth bore 4 of the gun body 40. The electrical timing circuit 34 is a network of electronic components that includes two solid state integrated circuit timers which control the launching sequence by sending energizing pulses to the solenoid valves 35 and 36 which function as electrically operated pneumatic flow distribution mechanisms. When actuated the solenoid valves 35 and 36 pass compressed gas flow from the first bore 1 and when not actuated the solenoid valves 35 and 36 operate to vent gas from the pressurized area. Upon initiation of the launching sequence the electrical timing circuit 34 energizes each solenoid valve 35 or 36 separately in a timed sequence to ensure that each solenoid valve 35 or 36 either passes or vents pressurized gas at the appropriate time within the launching sequence to propel a projectile 41 from the gun body 40.

DETAILED DESCRIPTION OF OPERATION

Before the initiation of a launching sequence the introduction of compressed gas into the first bore 1 will preferably automatically cause pneumatic pressure to be applied to the first end of piston 21*a* to cause gas flow from the first bore 1 to the compressed gas storage chamber 11 through actuation of the compressed gas filling mechanism 12 as described above. Simultaneously pneumatic pressure will preferably automatically be applied to the second end of piston 25*b* driving the bolt 26 to the shut position to disable the loading of a projectile 41. When these conditions are met the compressed gas storage chamber 11 is charged with the bolt 26 closed and the gun is ready for the initiation of a launching sequence.

A launching sequence is preferably initiated when the electrical switch 30 completes a circuit between the electrical power source 33 and the electrical timing circuit 34 as the cam shaped trailing edge of the trigger 8 contacts the plunger 31 to compress the spring 32. When contact is made the electrical power source 33 energizes the electrical timing circuit 34 which first sends an energizing pulse to actuate the first solenoid valve 35. When actuated the first solenoid valve 35 passes pressurized gas flow to the first end of piston 25*a* to actuate the projectile loading mechanism 14 by driving the bolt 26 back to the cocked position and to enable the loading of a projectile 41 into engagement with the bolt 26 from the projectile feed mechanism 29. The electrical timing circuit 34 then sends an energizing pulse to actuate the second solenoid valve 36 which then passes pressurized gas flow to the second end of piston 21*b* to actuate the compressed gas releasing mechanism 13. Simultaneously the first solenoid valve 35 returns to its non-actuated position to vent the first end of piston 25*a*. This venting in combination with the actuation of the compressed gas releasing mechanism 13 allows the stored gas released into the bolt port 27 from the compressed gas storage chamber 11 to drive the projectile 41 from the gun body 40.

After the launching sequence has been completed pneumatic pressure is again preferably automatically applied to the second end of piston 25*b* to drive the bolt 26 shut. Similarly pneumatic pressure is again preferably automatically applied to the first end of piston 21*a* to actuate the compressed gas filling mechanism 12 to re-pressurize the compressed gas storage chamber 11 as described above.

The launching sequence may then be repeated as many as nine times per second. The volume of the compressed gas storage chamber 11 and the bore interconnections 6 are preferably sized to produce projectile velocities in the 290 to 300 feet per second range at an operating gas pressure of approximately 125 pounds per square inch gauge pressure. However, the 1.5 cubic inch volume of the compressed gas storage chamber 11 and the 0.0315 square inch area of the bore interconnection orifices 6 will allow operation of the preferred embodiment at gas pressures of up to 175 pounds per square inch gauge pressure. As will be obvious to one skilled in the art, these parameters may be varied in order to allow for a differing operating gas pressure or projectile velocity.

While presently preferred embodiments have been shown and described in particularity, the invention may be otherwise embodied within the scope of the appended claims.

What is claimed is:

1. An electronically-operated pneumatic launching device comprising:

a gun-shaped body including a trigger;

a bolt for loading a projectile into a chamber during a loading operation, wherein said bolt is configured to be opened by the application of a pneumatic force;

a valve located in the body and configured to selectively supply compressed gas from a compressed gas source to the chamber during a firing operation; and an electrical circuit arranged in the body for initiating the firing operation of the launching device in response to actuation of the trigger.

2. A device according to claim 1, wherein the pneumatic force to open the bolt is applied to a first end of a pneumatic mechanism, and wherein the pneumatic mechanism is coupled to the bolt through a mechanical linkage.

3. A device according to claim 2, wherein the bolt is configured to be closed by the application of pneumatic force to a second end of the pneumatic mechanism.

4. A device according to claim 1, wherein said electrical circuit comprises an electronic solenoid configured to receive a signal from an electrical timing circuit to initiate the firing operation.

5. A device according to claim 4, wherein the electronic solenoid is part of a solenoid valve configured to route compressed gas to a pneumatically-controllable actuator to open the valve to cause compressed gas from the compressed gas source to enter the firing chamber during the firing operation.

6. A device according to claim 5, wherein the actuator is a pneumatic mechanism configured to be moved by operation of the solenoid valve.

7. A device according to claim 1, further comprising:

one or more solenoid valves configured to electro-pneumatically control a movement of the bolt for loading the projectile into the firing chamber based on an electronic signal from the electrical circuit; and wherein said one or more solenoid valves are further configured to control an opening of the valve to cause compressed gas to enter the firing chamber from the compressed gas source based on an electronic signal from the electrical circuit.

8. A device according to claim 7, further comprising:

a pneumatic mechanism configured to receive compressed gas from the one or more solenoid valves and to vent compressed gas through the one or more solenoid valves to operate the pneumatic mechanism;

the pneumatic mechanism communicating with the bolt via a mechanical linkage; and wherein operation of the pneumatic mechanism controls movement of the bolt.

9. A device according to claim 7, further comprising:

a compressed gas storage chamber configured to lie in a fluid path between the compressed gas source and the firing chamber to store compressed gas for the firing operation;

a pneumatic mechanism configured to receive compressed gas from the one or more solenoid valves and to vent compressed gas through the one or more solenoid valves to operate the pneumatic mechanism; and wherein said pneumatic mechanism is configured to open the valve to release compressed gas from the compressed gas storage chamber into the firing chamber.

10. An electronic circuit board for controlling the device of claim 1.

11. An electrically-controllable pneumatic projectile launching device, comprising:

a body comprising a trigger;

a bolt configured to be opened by the application of a pneumatic force; and an electronic circuit board mounted in the body, wherein the electronic circuit board initiates a launching operation based on trigger actuation.

12. A device according to claim 11, further comprising:

an electronic valve located in the gun body and configured to receive and selectively distribute compressed gas; and a pneumatic mechanism located in the gun body, wherein movement of a piston in the pneumatic mechanism is controlled by selective distribution of compressed gas through the electronic valve based on electrical signals from the electronic circuit board.

13. A device according to claim 12, wherein:

the piston is mechanically coupled to the bolt; and the pneumatic mechanism is configured to operate the bolt.

14. A device according to claim 12, wherein the pneumatic mechanism is configured to operate a firing valve to launch a projectile from the device.

15. A pneumatically operated projectile launching device, comprising:

a body which houses and interconnects pneumatic components and an electrical power source of the device;

a grip mounted to the body, said grip comprising a trigger and an electrical switch that activates a launching sequence of the device; and an electrical control unit housed within the body, the grip, or both, said electrical control unit configured to direct a flow of compressed gas between the pneumatic components to load and fire the device.

16. A device according to claim 15, wherein the electrical control unit comprises a solenoid valve.

17. A device according to claim 16, wherein the device is loaded by directing compressed gas through the solenoid valve to an end of a pneumatic mechanism to open a bolt, wherein the pneumatic mechanism is mechanically coupled to the bolt.

18. A device according to claim 16, wherein the device is fired by directing compressed gas through the solenoid valve to an end of a pneumatic mechanism to open a firing valve.

19. A device according to claim 15, comprising:

a power supply connection configured to receive power from a power supply;

an electrical timing circuit configured to receive electrical power through the power supply connection and to initiate a launching sequence of the device in response to actuation of a trigger; and at least one solenoid valve configured to receive one or more electronic pulses from the electrical timing circuit to launch a paintball from the paintball gun.

20. An electrical control unit according to claim 19, wherein the at least one solenoid valve comprises two three-way solenoid valves.

* * * * *

UNITED STATES PATENT AND TRADEMARK OFFICE

CERTIFICATE OF CORRECTION

PATENT NO. : 6,637,421 B2
DATED : October 28, 2003
INVENTOR(S) : Smith et al.

It is certified that error appears in the above-identified patent and that said Letters Patent is hereby corrected as shown below:

Column 1,
Line 9, should read -- FIELD OF THE INVENTION ¶ The present invention relates to a pneumatically operated projectile launching device. A preferred embodiment of the invention is designed for use in the recreational sport of "Paintball" (also known as "Survival" or "Capture the Flag"). --.
Line 38, "projectile-velocities" should read -- projectile velocities --.

Signed and Sealed this

Twenty-second Day of November, 2005

JON W. DUDAS
*Director of the United States Patent and Trademark Office*

US006637421C1

(12) EX PARTE REEXAMINATION CERTIFICATE (10645th)

United States Patent

Smith et al.

(10) Number: US 6,637,421 C1

(45) Certificate Issued: *Jul. 2, 2015

(54) PNEUMATICALLY OPERATED PROJECTILE LAUNCHING DEVICE

(75) Inventors: David L. Smith, East Aurora, NY (US); Raymond S. Gaston, Lancaster, NY (US); William M. Gardner, Jr., Ligonier, PA (US); Adam Gardner, Ligonier, PA (US)

(73) Assignee: KEE ACTION SPORTS, LLC., Sewell, NJ (US)

Reexamination Request:
No. 90/013,307, Aug. 5, 2014

Reexamination Certificate for:

| | |
|---|---|
| Patent No.: | **6,637,421** |
| Issued: | **Oct. 28, 2003** |
| Appl. No.: | **10/254,891** |
| Filed: | **Sep. 24, 2002** |

Certificate of Correction issued Nov. 22, 2005

( * ) Notice: This patent is subject to a terminal disclaimer.

Related U.S. Application Data

(63) Continuation of application No. 09/490,735, filed on Jan. 25, 2000, now Pat. No. 6,474,326, which is a continuation of application No. 08/586,960, filed on Jan. 16, 1996, now Pat. No. 6,035,843.

(51) Int. Cl.

| | |
|---|---|
| ***F41B 11/00*** | (2013.01) |
| ***F41B 11/70*** | (2013.01) |
| ***F41B 11/71*** | (2013.01) |
| ***F41B 11/57*** | (2013.01) |
| ***F41B 11/62*** | (2013.01) |
| ***F41B 11/721*** | (2013.01) |
| ***F41B 11/52*** | (2013.01) |

(52) U.S. Cl.
CPC ..... *F41B 11/57* (2013.01); *F41B 11/71* (2013.01); *F41B 11/62* (2013.01); *F41B 11/721* (2013.01); *F41B 11/52* (2013.01)

(58) Field of Classification Search
None
See application file for complete search history.

(56) References Cited

To view the complete listing of prior art documents cited during the proceeding for Reexamination Control Number 90/013,307, please refer to the USPTO's public Patent Application Information Retrieval (PAIR) system under the Display References tab.

*Primary Examiner* — Jeffrey R Jastrzab

(57) ABSTRACT

An electronically-operated pneumatic launching device preferably includes a gun-shaped body having a trigger. A bolt preferably permits a projectile to be loaded into a chamber during a loading operation. The bolt can be configured to be opened by the application of pneumatic force. A valve is preferably located in the body and selectively supplies compressed gas from a compressed gas source to the chamber during a firing operation. An electrical circuit is also preferably arranged in the body to initiate the firing operation of the paintball gun in response to actuation of the trigger.

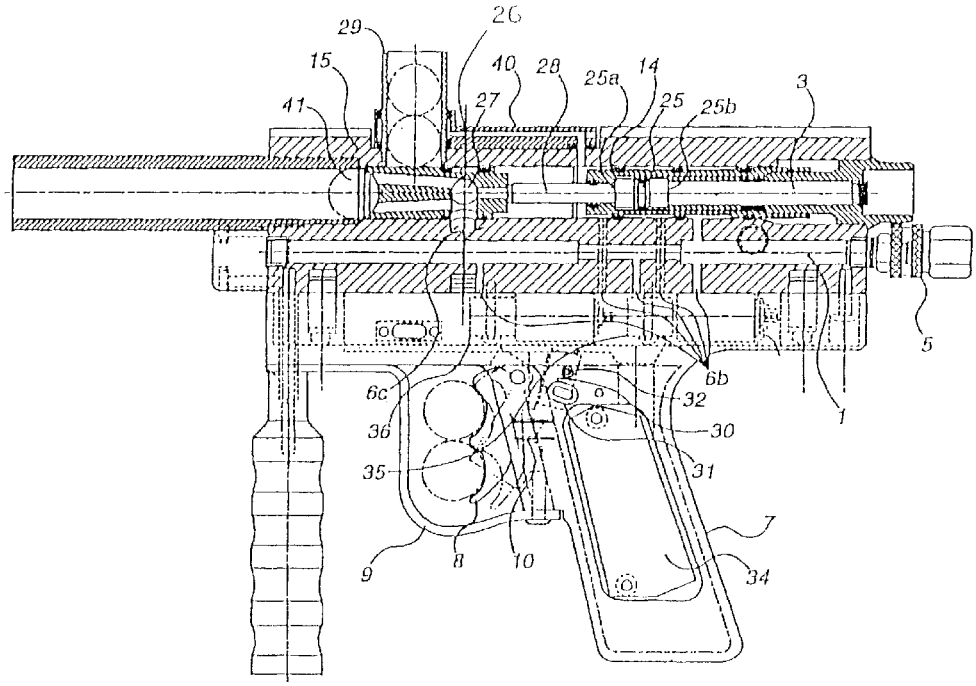

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-20 is confirmed.

* * * * *